US008844633B2

(12) United States Patent
Reitsma et al.

(10) Patent No.: US 8,844,633 B2
(45) Date of Patent: Sep. 30, 2014

(54) METHOD FOR MAINTAINING WELLBORE PRESSURE

(75) Inventors: Donald G. Reitsma, Katy, TX (US); Ossama R. Sehsah, Katy, TX (US)

(73) Assignee: At-Balance Americas, LLC, Houston, TX (US)

( * ) Notice: Subject to any disclaimer, the term of this patent is extended or adjusted under 35 U.S.C. 154(b) by 490 days.

(21) Appl. No.: 13/071,671

(22) Filed: Mar. 25, 2011

(65) Prior Publication Data

US 2011/0232914 A1 Sep. 29, 2011

Related U.S. Application Data

(60) Provisional application No. 61/318,427, filed on Mar. 29, 2010.

(51) Int. Cl.
*E21B 7/12* (2006.01)
*E21B 43/01* (2006.01)
*E21B 17/01* (2006.01)

(52) U.S. Cl.
USPC ..... 166/367; 166/335; 166/305.1

(58) Field of Classification Search
USPC ..... 166/335, 367, 305.1
See application file for complete search history.

(56) References Cited

U.S. PATENT DOCUMENTS

| | | | | |
|---|---|---|---|---|
| 4,046,191 | A * | 9/1977 | Neath | 166/352 |
| 4,291,772 | A * | 9/1981 | Beynet | 175/5 |
| 4,626,135 | A * | 12/1986 | Roche | 405/224.2 |
| 6,474,422 | B2 * | 11/2002 | Schubert et al. | 175/69 |
| 6,823,950 | B2 | 11/2004 | von Eberstein, Jr. et al. | |
| 6,904,981 | B2 | 6/2005 | van Riet | |
| 8,033,335 | B2 * | 10/2011 | Orbell et al. | 166/367 |
| 2003/0127230 | A1 | 7/2003 | von Eberstein et al. | |
| 2003/0196804 | A1 | 10/2003 | van Riet | |
| 2004/0238177 | A1 * | 12/2004 | Fossli | 166/364 |

OTHER PUBLICATIONS

International Preliminary Report on Patentability, International Application No. PCT/US2011/030316.
Notice of Grant of Application, Russian Patent Application No. 2012145545/03.

* cited by examiner

*Primary Examiner* — Brad Harcourt
*Assistant Examiner* — Catherine Loikith
(74) *Attorney, Agent, or Firm* — Seongyoune Kang; Richard A. Fagin

(57) ABSTRACT

A method for maintaining wellbore pressure includes reducing flow rate of a drilling fluid pump fluidly connected to a drill pipe in the wellbore. Flow out of the well is enabled into a first auxiliary line associated with a drilling riser. A seal around the drill pipe is closed. Fluid is pumped down a second auxiliary line at a rate selected to maintain a specific pressure in the wellbore. Drilling fluid flow through the drill pipe is stopped.

19 Claims, 6 Drawing Sheets

| | 50 gpm | 100 gpm | 150 gpm | 200 gpm | 250 gpm | 300 gpm | 350 gpm |
|---|---|---|---|---|---|---|---|
| Flow Rate ECD Sensitivity while Drilling, ppg | 9.31 | 9.35 | 9.39 | 9.43 | 9.47 | 9.51 | 9.60 |

*8.5" Hole Section (9.05 ppg MW)

| | **50 gpm** | **100 gpm** | **150 gpm** | 200 gpm | 250 gpm | 300 gpm | 350 gpm |
|---|---|---|---|---|---|---|---|
| Friction Loss in 4" Surface Lines and Choke Line, psi | **86.076** | **110.307** | **128.689** | 150.225 | 245.914 | 318.757 | 400.753 |
| Friction Loss in 4" Surface Lines and Choke Line, ppg | **0.157** | **0.201** | **0.235** | 0.274 | 0.449 | 0.582 | 0.732 |
| ECD While Flowing Through Choke Line, ppg | **9.48** | **9.53** | **9.58** | 9.62 | 9.81 | 9.96 | 10.12 |

*8.5" Hole Section (9.05 ppg MW)

Choke line friction calculation is for one choke line.
Use multiple choke lines if possible to reduce friction.

FIG. 3

106 • *Wiper trips will require pumping in and out of the hole in order to maintain pressure above pore point if the subsea stack is open.*

108 • *Stripping with a subsea annular is an option. Rotation is not recommended.*

110 • *Stripping ram to ram is an option. Rotation is not recommended.*

112 • *Trip out / in will require circulation to a static mud weight sufficient to overbalance the reservoir pressure. At Balance can advise mud rollover method to maintain a constant bottomhole pressure.*

FIG. 7

114 • *Extrapolate surface pressure and fluid column to obtain pressure below the BOP if a digital pressure sensor at the BOP is unavailable.*

116 • *DAPC pump start / stop sequence based on pipe ram position*

- ➤ *Start pump when rams are closed.* 118
- ➤ *Stop pump when rams are open.* 120

FIG. 8

METHOD FOR MAINTAINING WELLBORE PRESSURE

CROSS-REFERENCE TO RELATED APPLICATIONS

Priority is claimed from U.S. Provisional Application No. 61/318,427 filed on Mar. 29, 2010.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling wellbores through subsurface rock formations. More specifically, the invention relates to methods for controlling wellbore pressure during assembly or disassembly of lengths of drill pipe.

2. Background Art

Drilling wellbores through subsurface rock formations includes rotating a drill bit disposed at the end of a drill pipe disposed in the wellbore. Various devices are used to rotate the pipe and/or the bit while pumping drilling fluid through the pipe. The drilling fluid performs several functions, namely to cool and lubricate the bit, to lift drill cuttings out of the wellbore, and to provide hydraulic pressure to maintain wellbore mechanical stability and to restrain fluid under pressure in various permeable subsurface formations from entering the wellbore.

It is known in the art to use drilling fluid having lower specific gravity than that which would exert sufficient hydraulic pressure to retain fluids in such formations. One such technique is described in U.S. Pat. No. 6,904,981 issued to van Riet and commonly owned with the present invention. Generally, the system described in the '981 patent uses a rotating diverter or rotating control head to close the annular space between the drill string and the wellbore wall. Flow out of the wellbore is automatically controlled so that the fluid pressure at the bottom of the wellbore is maintained at a selected amount.

The drill pipe is assembled from a number of individual segments ("joints") of pipe threadedly coupled end to end. In order to lengthen the wellbore, it is necessary from time to time to add joints to the drill pipe. To remove the drill pipe from the wellbore, for example to replace the drill bit, it is necessary to threadedly disconnect sections ("stands") of the drill pipe from the part of the drill pipe remaining in the wellbore. When using the system described in the van Riet '981 patent, for example, it is desirable to include a one way ("check") valve in the drill pipe so that when the upper part of the drill pipe is opened, i.e., disconnected from a kelly or top drive, drilling fluid is prevented from flowing back up the drill string. Annulus pressure can be maintained using a back pressure pump, or by diverting some of the flow from the drilling unit fluid pumps into the annular space.

U.S. Pat. No. 6,823,950 issued to von Eberstein, Jr. et al describes a technique for maintaining wellbore pressure during connections for marine drilling systems in which a wellhead is located at the sea floor and a riser fluidly connects the wellbore to a drilling unit on the water surface. The method disclosed in the '950 patent requires filling an auxiliary fluid line associated with the riser system with higher density fluid and/or applying pressure to such line to maintain a selected fluid pressure in the wellbore.

A particular disadvantage of using the method described in the '950 patent is that switching from drilling to maintaining wellbore pressure during connections is that it requires the drilling unit operator exercise a high degree of care during the transition from drilling using the drilling unit pumps to the conditions necessary required to make a connection. There may be risk, for example of u-tubing because of the higher density fluid being inserted into the auxiliary line. This may create risk of exceeding formation fracture pressure at some point in the wellbore.

What is needed is a technique for maintaining wellbore pressure during the transition from drilling to making connections and during connections that does not require the use of higher density fluid in the auxiliary lines.

SUMMARY OF THE INVENTION

A method for maintaining wellbore pressure includes reducing flow rate of a drilling fluid pump fluidly connected to a drill pipe in the wellbore. Flow out of the well is enabled into a first auxiliary line associated with a drilling riser. A seal around the drill pipe is closed. Fluid is pumped down a second auxiliary line at a rate selected to maintain a specific pressure in the wellbore. Drilling fluid flow through the drill pipe is stopped.

Other aspects and advantages of the invention will be apparent from the following description and the appended claims.

BRIEF DESCRIPTION OF THE DRAWINGS

FIG. 3 is a table showing amount of flow through choke and kill lines needed to maintain an equivalent fluid density in the well as if drilling and circulating through the drill pipe at a selected flow rate.

FIG. 7 is an example "tripping" procedure.

FIG. 8 shows example modifications to the DAPC system in order to use the method of the invention.

DETAILED DESCRIPTION

Figure 1:
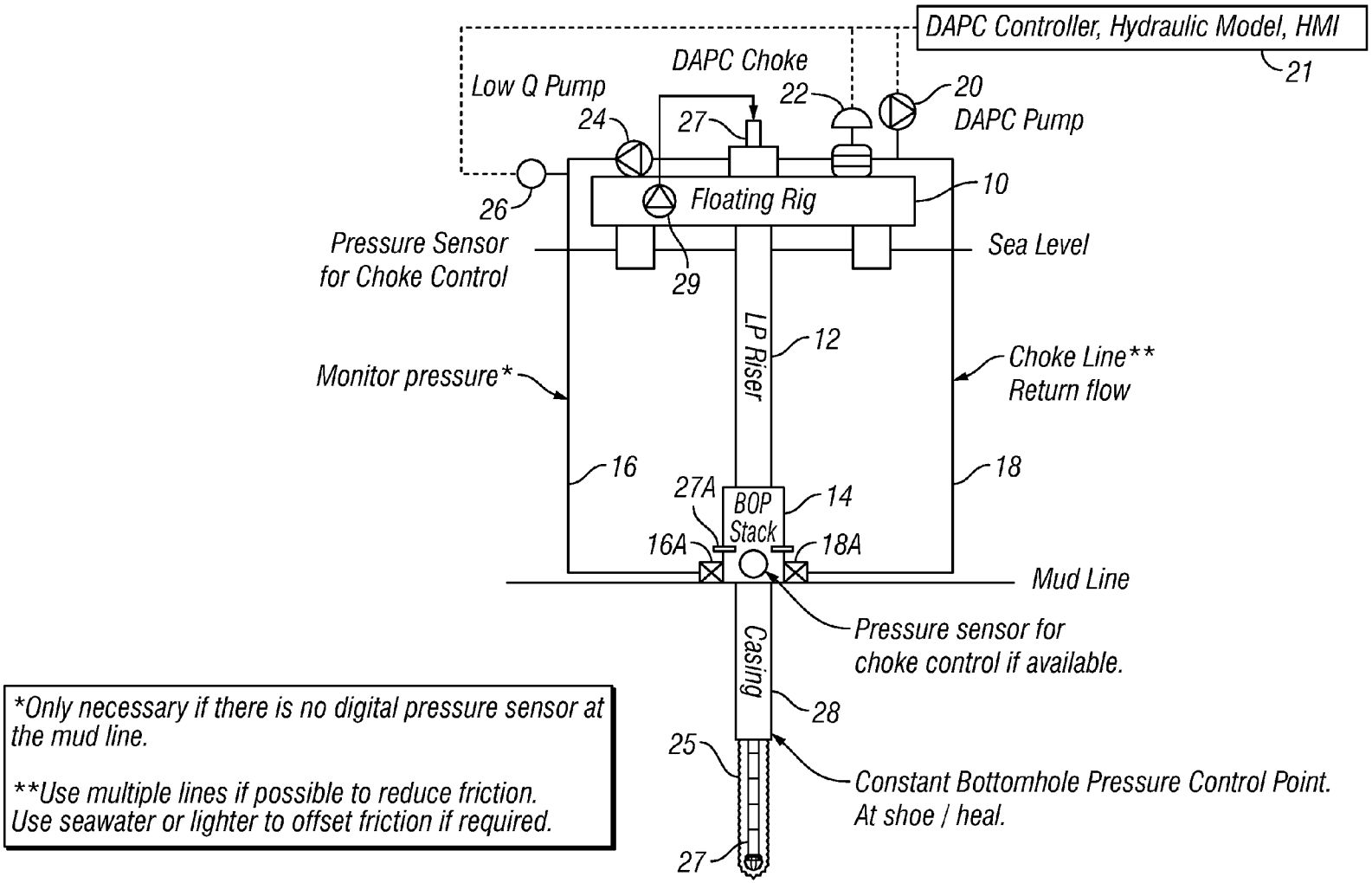
FIG. 1 schematically shows a floating drilling platform with a dynamic annular pressure control system and fluid circulation system according to the invention.

FIG. 1 shows an example of a floating drilling platform 10 that may be used with a method according to the invention. The floating drilling platform 10 typically includes a marine riser 12 that extends from the floating drilling platform 10 to a wellhead 14 disposed on the water bottom (mud line). The wellhead 14 includes various devices (not shown separately) to close the wellbore. Such wellhead devices may include pipe rams 27A to seal against the drill pipe (shown at 27 disposed inside the marine riser 12 and in the wellbore 25), an annular seal and blind rams to close the wellbore 25 when the drill pipe 27 is removed from the wellbore 25. In the present example a casing 28 is cemented in place in the wellbore 25 to a selected depth below the water bottom and is coupled at its upper end to the wellhead 14.

What is shown in FIG. 1 is a dynamic annular pressure control ("DAPC") system and its components, for example, the system described in U.S. Pat. No. 6,904,981 issued to van Riet and commonly owned with the present invention. The DAPC system may, but not necessarily include a controllable orifice or choke 22 in the drilling fluid return line, a backpressure pump 20 and a DAPC controller 21. The present invention may be used either with or without the DAPC system. A separate pump 24 or the drilling unit's drilling fluid pump 29 on the drilling platform 10 may be used to provide fluid flow into the drill pipe 27 and thus into the wellbore 25 at a selected rate. A pressure sensor 26 may be located proximate the wellhead 14 and used to indicate pressure in the wellbore 25. During assembly or disassembly of a pipe segment from the drill pipe (not shown), fluid may be pumped down one or more of the auxiliary lines 16 associated with the riser and wellhead system (e.g., choke lines, kill lines, booster lines). Fluid may be returned to the surface up one or more of the auxiliary lines 18. Such procedure will be further explained below with reference to FIGS. 5, 6 and 7.

Figure 2:
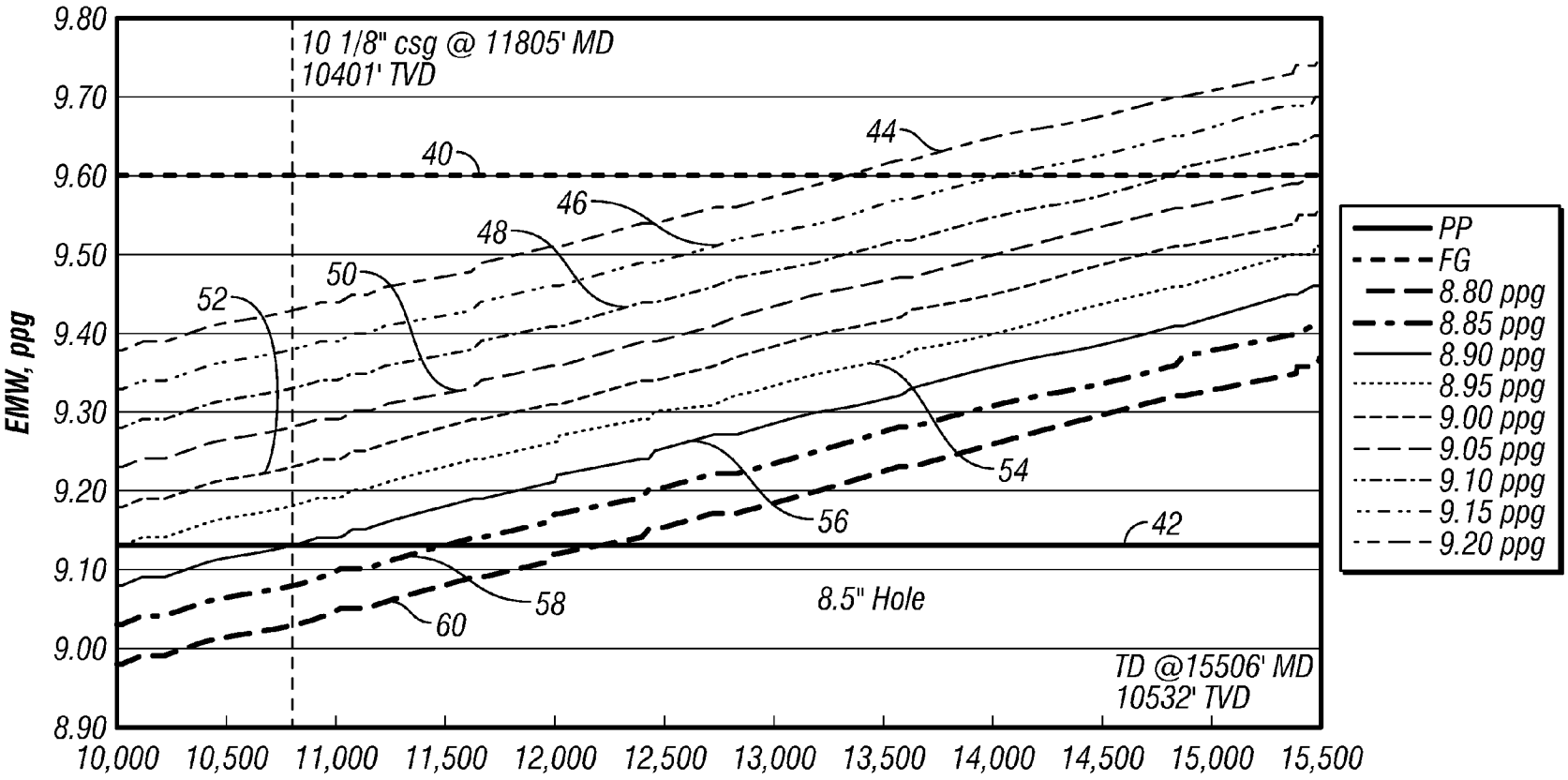
FIG. 2 shows a graph of equivalent drilling fluid densities at the bottom of a well while circulating with respect to the depth of the well and the actual density of the drilling fluid.

FIG. 2 shows a graph of equivalent circulating fluid densities at various wellbore depths for various static fluid densities, shown by curves 44 through 60. The densities are expressed in terms of "mud weight", which as known in the art is typically expressed in units of pounds weight per gallon volume of drilling fluid. As may be observed by the curves 44 through 60 FIG. 2, the equivalent circulating density increases ("ECD") with respect to depth for any particular flow rate of fluid into the wellbore. When fluid flow into the wellbore is stopped, such as for making a connection (i.e., adding or removing a segment to the drill string), the fluid density will drop to its static value. Limits of fluid pressure within the wellbore at any depth are indicated by curves 40 and 42, which represent, respectively, the formation fracture pressure expressed in mud weight equivalent (gradient) terms and the pressure of fluid in the formations being drilling (formation pore pressure) also expressed in mud weight equivalent terms for consistency with the drilling fluid pressures shown by curves 44 through 60.

Using the system shown schematically in FIG. 1, and referring to the tables FIG. 3, it can be observed what rate of fluid flow is needed through auxiliary lines (e.g., 16 and 18 in FIG. 1) to provide the equivalent bottom hole pressure ("BHP") of drilling fluid circulating through the drill pipe at selected drilling fluid flow rates.

Figure 4:
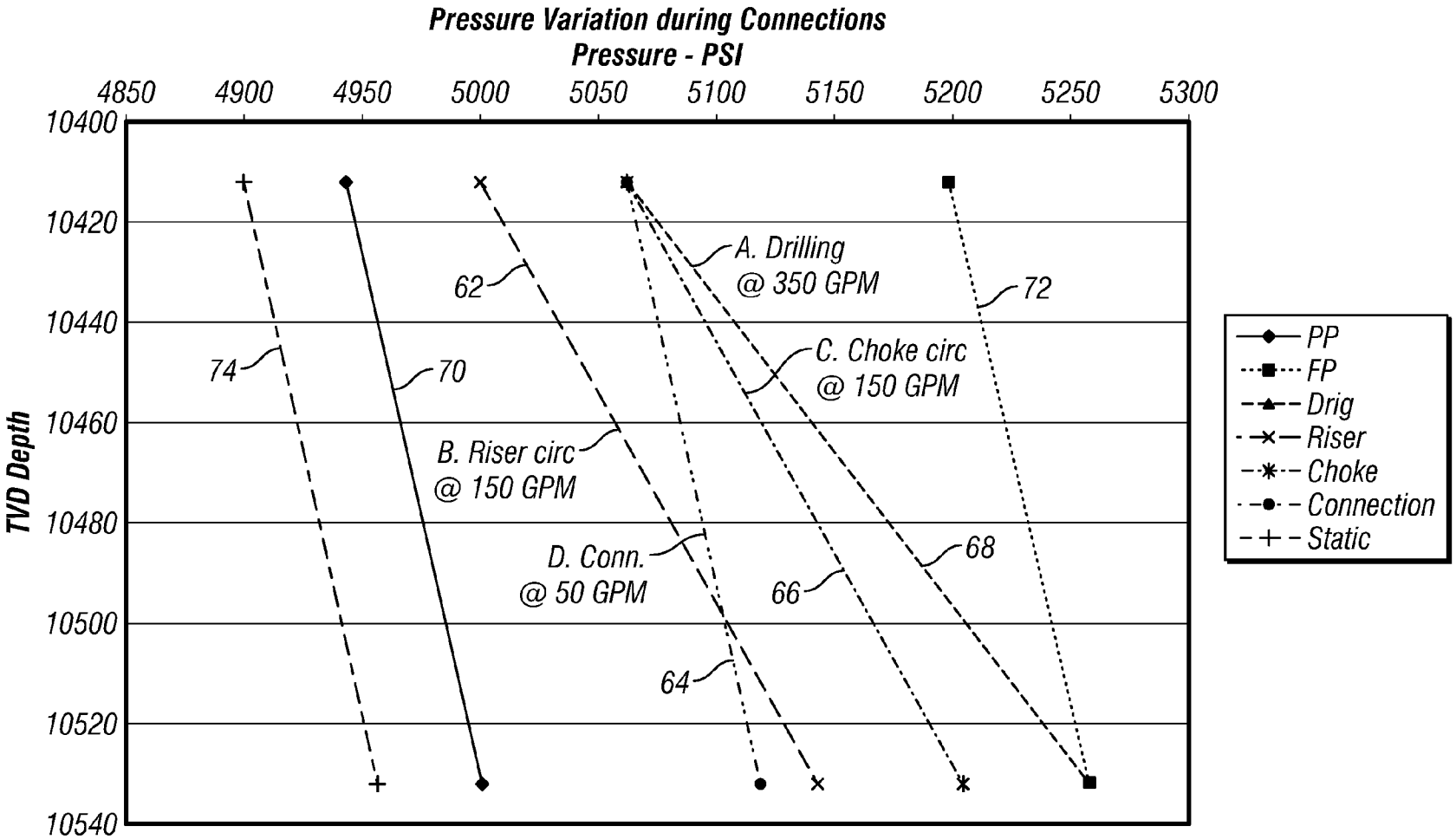
FIG. 4 is a graph showing pressure variation during pipe connections.

FIG. 4 graphically illustrates fluid pressure (expressed in units of pressure) with respect to wellbore depth. Curve 74 shows the fluid pressure with respect to depth when no circulation takes place. Curve 70 represents the formation fluid (pore) pressure with respect to depth, and curve 72 represents the formation fracture pressure with respect to depth during. It may be observed in FIG. 3 that the drilling fluid has a static gradient that is below the formation fluid pressure gradient. Therefore, using the drilling fluid having static gradient shown in FIG. 3 would require addition of fluid pressure to the wellbore when drilling operations are interrupted in order to prevent fluid influx from the formation into the wellbore. Curve 68 shows the wellbore fluid pressure with respect to depth while drilling, wherein the drilling platform (or other) pump is operated at a rate of 350 gallons per minute. Curve 62 shows the fluid pressure with respect to depth when pumping fluid into the base of the riser (12 in FIG. 1) at 150 gallons per minute. Curves 64 and 66 show, respectively, the fluid pressure with respect to depth while pumping fluid using the system shown in FIG. 1, at rates of 50 gallons per minute and 150 gallons per minute.

Figure 5:
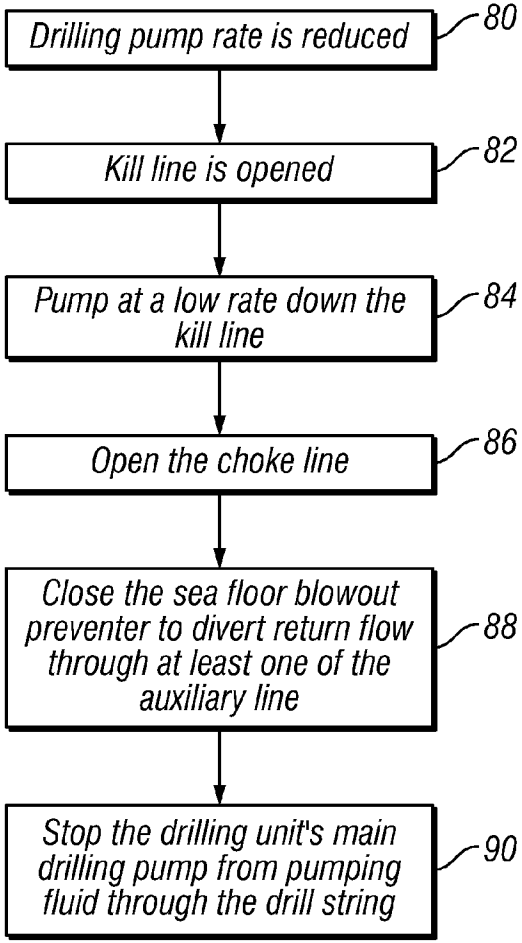
FIG. 5 is a flow chart of initiating the connection procedure according to the invention.

FIG. 5 shows a flow chart of initiating a circulation procedure according to the invention. First, the drilling rig pump rate is reduced, as shown at 80. The kill line (e.g., 16 in FIG. 1) may be opened at 82 for pressure monitoring. The pump (24 in FIG. 1) may be operated at a low rate at 84 to move fluid down the kill line (16 in FIG. 1) if seawater is used to ensure a singular fluid. Then the choke line(s) (18 in FIG. 1) may be opened, as shown at 86, for example, by operating a valve (16A in FIG. 1) proximate the blowout preventer. Different density fluid may be needed to offset choke line friction when the pump (24 in FIG. 1) is operated. It is preferable to use multiple riser auxiliary lines for fluid return to the platform if the riser system used makes this possible in order to reduce friction losses in the circulation system. Next, at 88, the sea floor blowout preventer (14 in FIG. 1) is closed to divert return flow through at least one of the auxiliary line(s), e.g., choke line (18 in FIG. 1). Such closure may include closing an annular seal (not shown separately) and/or pipe rams (not shown separately) on the blowout preventer. The choke line may be hydraulically connected to the wellbore, for example, by operating a valve (18A in FIG. 1) proximate the blowout preventer. At 90, the drilling platform's main drilling pump is stopped to cease pumping fluid through the drill string. The control point pressure in the wellbore (25 in FIG. 1) is then maintained by pumping fluid at a selected flow rate down the kill line (16 in FIG. 1).

During this time, the upper end of the drill pipe may be disconnected from the drilling unit main pumps and a connection may be made or broken (i.e., a segment of drill string may be added or removed from the drill string). The fluid pressure during this time is maintained in the wellbore so that the ECD remains above the formation pore pressure, thereby reducing the possibility of formation fluid entering the wellbore.

Figure 6:
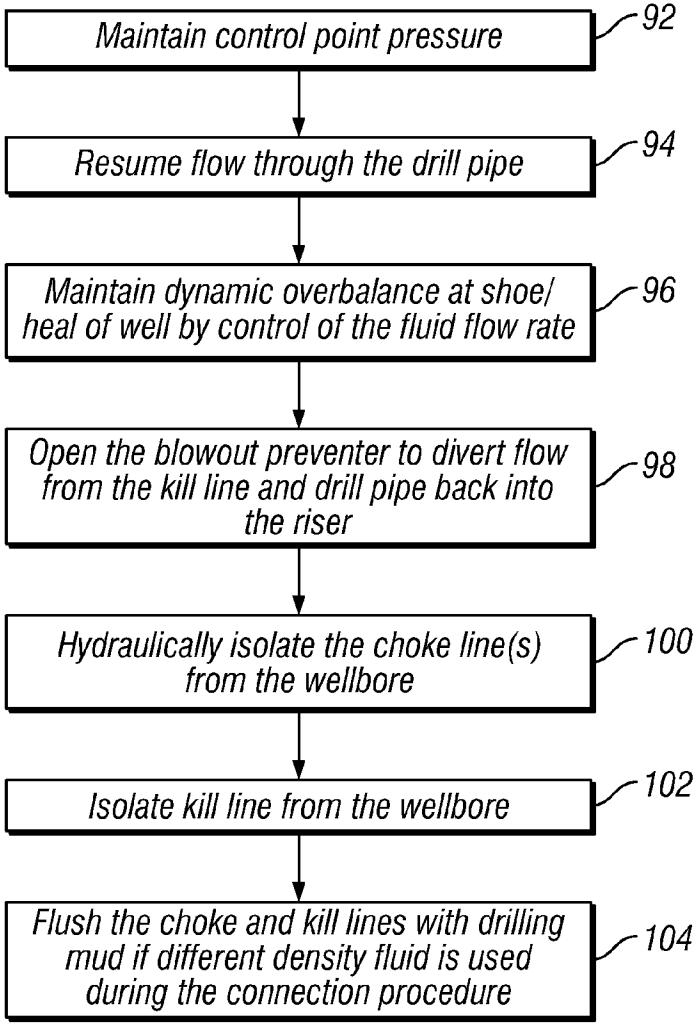
FIG. 6 is a flow chart of initiating drilling according to the invention.

FIG. 6 shows a flow chart of an example procedure used to resume drilling after maintain pressure as explained with reference to FIG. 5. At 92, the control point pressure is maintained using the pumping technique explained with reference to FIG. 5. At 94, the drilling unit's main fluid pumps may be restarted to resume drilling flow through the drill pipe. At 96, dynamic wellbore fluid pressure is maintained at the casing shoe (top of 28 in FIG. 1) or the heel of the wellbore (25 in FIG. 1) by control of the fluid flow rate both into the drillstring and into the kill line (16 in FIG. 1). The blowout preventer may then be opened, at 98, to divert return fluid flow from the choke line (18 in FIG. 1) and drill pipe back into the riser (12 in FIG. 1). At 100, the choke line(s) are hydraulically isolated from the wellbore, e.g, by closing the valve (18A in FIG. 1). Also at 100, the pump (24 in FIG. 1) may be stopped if it is in use, or stop flow from the drilling rig pump if it is being used to move fluid through the kill line (16 in FIG. 1). Then, at 102, the kill line (16 in FIG. 1) is isolated from the wellbore, e.g., by operating the valve (16A in FIG. 1). Finally, at 104, the choke and kill lines may be flushed with drilling mud if a different density fluid is used during the connection procedure.

FIG. 7 explains procedures that may be used with certain operations including axial motion of the drill pipe (e.g., "trips"). At 106, "wiper" trips will require pumping while moving the drill pipe in and out of the wellbore in order to maintain pressure above formation pore pressure if the blowout preventer is open. At 108, "stripping" with an annular sealing element in the blowout preventer is one possible option. Rotation of the drill string is not recommended if an annular seal is used. At 110, stripping from one pipe ram to another pipe ram in the blowout prevented, when the blowout preventer includes multiple pipe rams, is another possible option. Rotation of the drill string is not recommended if multiple pipe rams are used. At 112, a full trip out of the wellbore or into the wellbore can be performed using the procedure explained with reference to FIG. 5.

In addition, and referring to FIG. 8, one can extrapolate the surface pressure and height of the fluid column, at 114 to obtain pressure below the blowout preventer ("BOP") if a pressure sensor at the BOP is unavailable. At 116, the pump (24 in FIG. 1) start/stop sequence may be performed based on the pipe ram position. At 118, the pump may be stopped when the pipe rams are closed. At 120, the pump may be started when the pipe rams are open.

A method according to the invention provides a technique to maintain a selected pressure in the wellbore while making pipe connections.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

enabling flow out of a wellbore into a first auxiliary line associated with a drilling riser;

pumping fluid down a second auxiliary line at a rate selected to maintain a specific pressure in the wellbore;

isolating the second auxiliary line from at least one of a first pump used to pump fluid through a pipe string in the wellbore and a second pump used to pump fluid down the second auxiliary line; and isolating the first auxiliary line from the wellbore.

2. The method of claim 1 further comprising sealing an annular space between the wellbore and a pipe string disposed therein, disconnecting the first pump from an end of the pipe string, and at least one of connecting and disconnecting a segment of pipe from the pipe string.

3. The method of claim 2 further comprising:

maintaining the specific pressure;

reconnecting the first pump to the_end of the pipe string;

starting flow of fluid through the pipe string; and unsealing the annular space.

4. The method of claim 2 wherein the sealing comprises closing pipe rams in a blowout preventer stack.

5. The method of claim 2 wherein the sealing comprises closing an annular seal in a blowout preventer.

6. The method of claim 2 further comprising moving the pipe string longitudinally and at least one of connecting and disconnecting an additional segment of pipe from the pipe string.

7. The method of claim 1 wherein the first auxiliary line comprises a choke.

8. The method of claim 1 wherein the pumping fluid into the second auxiliary line comprises pumping fluid from a drilling fluid pump.

9. The method of claim 1 wherein the specific pressure is selected to provide a same equivalent circulating density as a fluid when pumped at a selected rate through the pipe string disposed in the wellbore.

10. The method of claim 1 wherein the first and second auxiliary lines are in hydraulic communication with the wellbore below a seal disposed between a pipe extending into the wellbore and a wall of the wellbore when flow through the auxiliary lines is enabled.

11. A method, comprising:

reducing flow rate of a drilling fluid pump fluidly connected to a drill pipe in a wellbore;

enabling flow out of the wellbore into a first auxiliary line associated with a drilling riser;

closing a seal around the drill pipe;

pumping drilling fluid down a second auxiliary line at a rate selected to maintain a specific pressure in the wellbore using at least one of the drilling fluid pump and an auxiliary pump;

stopping the drilling fluid flowing through the drill pipe;

disconnecting the drilling fluid pump from the drill pipe, and at least one of connecting and disconnecting a segment of pipe from the drill pipe;

maintaining the specific pressure;

reconnecting the drilling fluid pump to the upper end of the drill pipe;

restarting flow of the drilling fluid through the drill pipe;

opening the seal; and isolating the second auxiliary line from the at least one of the drilling fluid pump and the auxiliary pump and isolating the first auxiliary line from the wellbore.

12. The method of claim 11 wherein the seal comprises pipe rams in a blowout preventer stack.

13. The method of claim 11 wherein the first auxiliary line comprises a choke.

14. The method of claim 11 wherein the pumping fluid into the second auxiliary line comprises pumping fluid from the drilling fluid pump.

15. The method of claim 11 wherein the first and second auxiliary lines are in hydraulic communication with the wellbore below a blowout preventer when flow through the auxiliary lines is enabled.

16. A method, comprising:

flowing fluid out of a wellbore through a first line in fluid communication with the wellbore;

sealing an annular space between a pipe disposed in the wellbore and the wellbore such that the annular space below a location where the annular space is sealed is isolated from the annular space above the location, wherein the first line directs fluid from the annular space below the location;

pumping fluid into the wellbore through a second line in fluid communication with the wellbore below_the location so as to maintain a selected pressure in the wellbore;

starting fluid flow into the wellbore through the pipe;

unsealing the annular space; and hydraulically isolating the first line and the second line from the wellbore.

17. The method of claim 16 wherein the pumping fluid into the second auxiliary line comprises operating a pump separate from a pump used to start fluid flow into the pipe.

18. The method of claim 16 wherein the selected pressure is selected to provide a same bottom hole pressure as the fluid when pumped at a selected rate through the pipe.

19. The method of claim 16 wherein the sealing comprises closing an annular seal in a blowout preventer.

* * * * *